US005799458A

United States Patent [19]

Ferguson

[11] Patent Number: 5,799,458

[45] Date of Patent: Sep. 1, 1998

[54] BACK-BLOCKING DEVICE AND METHOD FOR DRYWALL JOINT ATTACHMENT

[76] Inventor: Myron R. Ferguson, 984 Ridge Rd., Broadalbin, N.Y. 12025

[21] Appl. No.: 854,896

[22] Filed: May 13, 1997

[51] Int. Cl.[6] ..... E04B 2/56

[52] U.S. Cl. ..... 52/417; 52/281; 52/582.1; 52/712; 52/731.7; 52/731.9; 52/745.09

[58] Field of Search ..... 52/222, 281, 417, 52/582.1, 712, 731.7, 731.9, 459, 745.09

[56] References Cited

U.S. PATENT DOCUMENTS

| | | | |
|---|---|---|---|
| 1,609,541 | 12/1926 | Gooding | 52/731.9 X |
| 3,305,252 | 2/1967 | Jureit | 52/712 |
| 3,576,091 | 4/1971 | Shull, Jr. et al. . | |
| 3,675,383 | 7/1972 | Paoletti | 52/222 |
| 3,842,551 | 10/1974 | Shull et al. . | |
| 3,901,471 | 8/1975 | Hilgers . | |
| 3,995,401 | 12/1976 | Smith . | |
| 4,045,932 | 9/1977 | Bogert . | |
| 4,196,556 | 4/1980 | Russo . | |
| 4,231,197 | 11/1980 | Caplan et al. . | |
| 4,237,669 | 12/1980 | Hunter | 52/417 |
| 4,283,898 | 8/1981 | Claver . | |
| 4,296,580 | 10/1981 | Weinar . | |
| 4,333,286 | 6/1982 | Weinar . | |
| 4,392,336 | 7/1983 | Ganssle | 52/417 |
| 4,397,123 | 8/1983 | Parker . | |
| 4,397,127 | 8/1983 | Mieyal . | |
| 4,448,007 | 5/1984 | Adams . | |
| 4,453,362 | 6/1984 | Rodgers . | |
| 4,467,578 | 8/1984 | Weinar . | |
| 4,498,272 | 2/1985 | Adams . | |
| 4,499,701 | 2/1985 | Bockwinket et al. . | |
| 4,584,224 | 4/1986 | Schneller | 52/417 X |
| 4,641,474 | 2/1987 | Cannarsa | 52/714 X |
| 4,658,556 | 4/1987 | Jenkins . | |
| 4,672,787 | 6/1987 | Murphy . | |
| 4,727,700 | 3/1988 | Eberle . | |
| 4,757,663 | 7/1988 | Kuhr . | |
| 4,763,455 | 8/1988 | Schneller | 52/417 X |
| 4,782,642 | 11/1988 | Conville . | |
| 4,809,476 | 3/1989 | Satchell . | |
| 4,811,539 | 3/1989 | Menchetti . | |
| 4,854,096 | 8/1989 | Smolik . | |
| 4,912,898 | 4/1990 | Holmes . | |
| 4,995,605 | 2/1991 | Conville . | |
| 5,003,743 | 4/1991 | Bifano et al. . | |
| 5,222,335 | 6/1993 | Petrecca . | |
| 5,230,200 | 7/1993 | Douglas et al. . | |
| 5,313,753 | 5/1994 | Sanger . | |
| 5,321,924 | 6/1994 | Smolik . | |
| 5,487,250 | 1/1996 | Yount et al. . | |
| 5,498,099 | 3/1996 | Scheuer . | |
| 5,657,599 | 8/1997 | Peterson et al. | 52/417 |

OTHER PUBLICATIONS

Ferguson, Myron R., *Drywall, Professional Techniques for Walls and Ceilings*, Taunton Press, Inc. (1996), at pp. 102 and 103.

*Primary Examiner*—Christopher Kent
*Attorney, Agent, or Firm*—Jay R. Yablon

[57] ABSTRACT

A back-blocking device and method designed to attach any thickness of drywall together at the butt ends of the panels. Butt seams are necessary because of larger ceilings and walls where using one length drywall panels is impossible. Using conventional techniques, butt seams are difficult to conceal and are subject to ridging. This device and method enables the joints to be made between the framing members by securing each end to a specially designed back-blocking. This union creates a joint that attaches the panels together, basically creating a continuous piece of drywall. The back-blocking is slightly angled down the center, at an angle of approximately 170 degrees. Each long edge of the back-blocking is thicker than the remaining back-blocking, which, combined with the slight (approximately 10 degree) difference between the 170 degree angle and a straight 180 degree angle, creates a recessed joint when the drywall is screwed along the center crease of the back-blocking, which enables the seam to be fully hidden and prevents ridging.

18 Claims, 3 Drawing Sheets

BACK-BLOCKING DEVICE AND METHOD FOR DRYWALL JOINT ATTACHMENT

FIELD OF THE INVENTION

This invention pertains generally to the installation of drywall materials, and specifically, discloses a novel, non-obvious device and method for creating a seamless, easy-to-conceal butt joint between adjoining drywall panels and helping to prevent or minimize ridging.

BACKGROUND OF THE INVENTION

When professionals hang (attach) drywall, they are always thinking of eliminating unnecessary joints. Drywall panels are typically produced in lengths up to 16 feet, and standard widths of 48 and 54 inches.

The long edges of drywall panels are tapered slightly to accommodate joint tape and compound. The panel ends are cut square and finished smooth with the gypsum core exposed, and are thus untapered. Similarly, whenever a drywall panel is cut by a contractor or other drywall installer, the cut edge is of course untapered.

When it becomes necessary to butt the untapered ends of panels together, for instance on any wall or ceiling over 16 feet long, a butt joint is formed. If no modifications are made and the ends are attached directly to the framing, the seam which is formed is difficult to conceal. The main reason for this is that the cut drywall edge at the seam is not tapered at all. Once joint tape and compound are applied, a slight bump is formed, and even a highly skilled professional has a difficult time hiding this joint, particularly under certain lighting conditions.

Additionally, building materials expand or contract as the temperature and humidity inside a building change. As the building materials move, tension builds up against the drywall panels. The tension is relieved as the panels bend outward, usually at a joint. This so-called ridging can occur in regular tapered edge seams, but it is much more common in butted end joints. It would be very helpful if a device and method can be designed to minimize ridging in the first place by allowing butt joints to readily be placed between framing members, and to compensate for the absence of tapering along cut drywall edges. Such a device and method would also make it easier to form a good finished surface over a twisted stud or joist.

Numerous efforts have been made in the prior art to solve the problems outlined above. U.S. Pat. No. 4,237,669, issued Dec. 9, 1980, is designed to enable wallboard to be attached to a so-called seam eliminator between framing and compressed at the seams, by locking the seams together so the wallboard cannot move and cause re-appearance of the seam. However, in this invention, three or four brackets are needed for each butt joint, and each bracket has to be secured to the framing, which takes quite a bit of time to install. In addition the flanges lap the framing which forces the drywall panels out slightly on the framing, and could cause problems when screwing the face of the drywall along the framing to which the brackets are attached.

U.S. Pat. No. 5,487,250, issued Jan. 30, 1996, discloses a method of concealing joints on predecorated wallboard. But its teachings do not apply for regular drywall, and it does not address the issues pertaining to butted seams.

U.S. Pat. No. 5,230,200, issued Jul. 27, 1993, is designed to reduce ridging at seams by using a specially-designed wall board and a sealing compound that requires no tape. However, the disclosure in this patent deals with long tapered edges of the wall board, not the butt end seams.

U.S. Pat. No. 4,995,605, issued Feb. 26, 1991, teaches how to secure drywall panels together independent of framing studs, and is also used for quick and convenient repair of wallboard panel. While this invention can be used to support the butt end joints between framing, this is mainly done to save time cutting the wallboard and to reduce waste. The clips do not recess the wallboard at the butt joints for easy concealment with tape and joint compound. Further, since the clips disclosed in this patent are spaced every 8 to 10 inches along a butted seam, there are significant intermediate spaces that are not supported.

There are many other U.S. Patents also disclosing some sort of clips to attach or secure wallboard, all involving some or all of the limitations of U.S. Pat. No. 4,995,605 above, such as: U.S. Pat. No. 4,467,578, for concealed fastening clips that secure drywall to framing; U.S. Pat. No. 4,782,642, which is an earlier filing of which U.S. Pat. No. 4,995,605, above, is a continuation-in-part with the same inventor and similar limitations; U.S. Pat. No. 4,641,474, which is used to secure a loose section of wallboard in place, mainly for repairs; U.S. Pat. No. 4,333,286, wherein clips are used to secure drywall to framing (not between framing) on long edges and butted ends of wallboard; and U.S. Pat. Nos. 4,498,272 and U.S. Pat. No. 4,448,007, same inventors, which secures wallboard directly to framing.

U.S. Pat. No. 4,397,123, issued Aug. 9, 1983, discloses a specially-designed wallboard with tear off strips on the back of the butt ends of the panels. When the strips are removed the ends are attached to the framing with screws or nails. The ends are forced inward creating a recessed butt seam. While helpful, a special wallboard would need to be purchased, which could be quite expensive. Also, while recessed, the butt ends are still secured to the framing. This disclosure does not provide a way to recess the butt seams and also float the butt seam between framing, which would greatly reduce the chances of the seam reappearing when lumber shrinks or moves because of warping or settling.

U.S. Pat. No. 4,392,336, issued Jul. 12, 1983, creates recessed butt end seams in wallboard. Wallboard is attached between framing to metal strip members that are attached to framing. Four to six strips are used for each butt joint. This invention is similar to U.S. Pat. No. 4,237,669, discussed above. However, in this disclosure, a number of brackets (four to six) are needed for each butt joint, and each bracket has to be secured to the framing. These would take quite of bit of time to install. Additionally, the flanges lap the front of the framing, which forces the wallboard panels out slightly on the framing and could cause problems when screwing the face of the drywall along the framing the brackets are attached to.

U.S. Pat. No. 3,675,383, issued Jul. 11, 1972, is designed to eliminate the ridge formed at butt joints, by forming the butt joint between, rather than on the framing. However, this is essentially a long clip that each end of abutting panels slides into. It is slightly angled so that once the joined panels are secured to the framing the butt joint is forced slightly inward. However, different clips would be needed for different thickness of drywall. Also, the clip is secured to the drywall with adhesives, which can be messy. Further, it is cumbersome sliding the butting panel into the clip that is already attached to the first panel. Finally, a metal edge is exposed on the finish side of the drywall prior to taping. Tape and compound works best when applied directly to the drywall surface, and so it would be desirable to avert a metal edge on the finish side of the drywall.

All other prior art not specifically cited here has many of the problems as the art discussed above. It would be desirable if a device and method could be developed that averts all of the problems cited above with respect to the prior art.

OBJECTS OF THE INVENTION

It is therefore an object of this invention to allow non-tapered (butt) edges of drywall to be joined between, rather than upon, framing members.

It is a further object of this invention to cause these edges to be joined with a slight recess relative to the plane of the finish side of the drywall, so that tape and joint compound can be applied to provide a finished joint that is seamless in appearance.

It is a further object of this invention to achieve this with a single unit of back-blocking hardware, rather than multiple units, clips, brackets, etc. to facilitate ease of use and saving of installation time.

It is a further object of this invention to have this single extra piece of back-blocking hardware span the entire butt joint, thereby providing a sturdy, secure attachment along the entire length of the butt joint, rather than only at certain intervals.

It is a further object of this invention to achieve this in a way that is very simple and non-cumbersome, and that requires little, if any, extra installation time.

It is a further object of this invention to avert placing or attaching any part of the back-blocking hardware on the front face of the framing, so as to avoid any slight bulging that this would cause at the point of framing attachment.

It is a further object of this invention to avert the need to attach the back-blocking hardware to any portion of the framing whatsoever, thereby greatly simplifying installation, and making the butt joint independent of any shifting or settling of the framing materials.

It is a further object of this invention to provide back-blocking hardware that is lightweight and compact, so that large numbers of these back-blocking hardware units can easily be transported to and stored at a construction site precedent to their use and stored in a small space.

It is further object of this invention to achieve the above without requiring any modification whatsoever to drywall sheets themselves, or the addition of extra tape or adhesive strips to the drywall sheets.

It is a further object of this invention to ensure that no metal edge is exposed on the finish side of the drywall prior to taping, so that tape and compound can be applied directly to the drywall itself for optimum adhesion.

It is a further object of this invention for the back-blocking to work universally, with any thickness of drywall, and not be constrained by the drywall thickness or have to be manufactured in a variety of configurations or sizes corresponding to variations in drywall thicknesses.

It is a further object of this invention to secure the drywall to the back-blocking solely with drywall screws, without the need for any form of glue or adhesive which can be messy.

It is a further object of this invention to enable the second abutting drywall panel being placed, to easily be positioned against and butted with the adjacent first panel placed, once said first panel and the drywall backing are in place.

It is further object of this invention to avoid the use of any clips in creating the butt joint.

It is a further object of this invention to enable the creation of a seamless joint along butt joints of any and all lengths, without restriction.

As will be demonstrated below, none of the prior art is as quick and easy to use as this invention. This invention is inexpensive and efficient and it works with any thickness of drywall. No clips or adhesives are used and the back-blocker is not attached to any framing. It only attaches the two panels together, creating a recessed, floating seam that is easy to conceal with conventional taping methods and it is resistant to ridging.

SUMMARY OF THE INVENTION

The Back-blocking Device and Method (back-blocking strip) disclosed herein is a specially formed bracket designed to attach the butt ends of drywall panels together. In the preferred embodiment, it is made of galvanized sheet metal of 20 to 25 gauge, and the outside edges of the sheet metal are folded over onto themselves to create a thicker, raised outside edge, about ⅛ inch thick.

The length of each strip is approximately 47 or 53 inches, to accommodate the two predominate manufactured widths (48 inches and 54 inches) of drywall panels, but a strip can be cut to shorter lengths with, e.g., tin snips, so it can be used for narrower widths of drywall. These strips can of course also be manufactured in other lengths as well. A strip is about 10 inches wide and bent in the middle (i.e. about 5 inches from each side) along its length, inward toward the raised edges to about a 170 degree angle, i.e., to an angle of about 10 degrees from an unbent 180 degree strip. If the raised outside edges are made thinner or thicker than the ⅛ inch thickness noted above, this angle may be varied (e.g., to an angle from perhaps 5 to 20 degrees) to compensate accordingly. A knurled or dimpled surface allows for easier penetration of drywall screws.

The first drywall panel is attached to the wall or ceiling framing in a conventional manor. The panel is cut so that the butt edge falls roughly on center between, not upon, framing members. Once the first panel is secured in place the back-blocker is held in place centering it along the butt edge of the panel, i.e., with the bend in the panel directly behind where the butt joint will be. The concave side of the strip is mounted to face out toward the finished surface of the drywall, and the raised edges thereby also faces out toward, and contact the hidden (unfinished) surface of, the drywall. Drywall screws designed for securing drywall to metal framing are used to attach the drywall to the back-blocking, which is held in place by hand as the screws are installed.

Once the back-blocking is completely secured to the first panel, the abutting (second) panel is placed so as to butt against the first panel, is next attached to the framing, and is finally attached to the back-blocking.

As the drywall is attached to the back-blocking strip with these screws, the angle of the bend in the strip combined with the thicker outside edge draw the drywall inward toward the strip and inward from the plane of the finished wall, forming a gradual inward curve that results in minimal stress on the drywall. This recessed (indented) seam is now easy to conceal with tape and joint compound. The panels are attached to each other, not to the framing, along the butted seam, which greatly reduces the chance of the ridging caused by expansion or contraction of building materials.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE PREFERRED EMBODIMENT OF THE INVENTION

Figure 1:
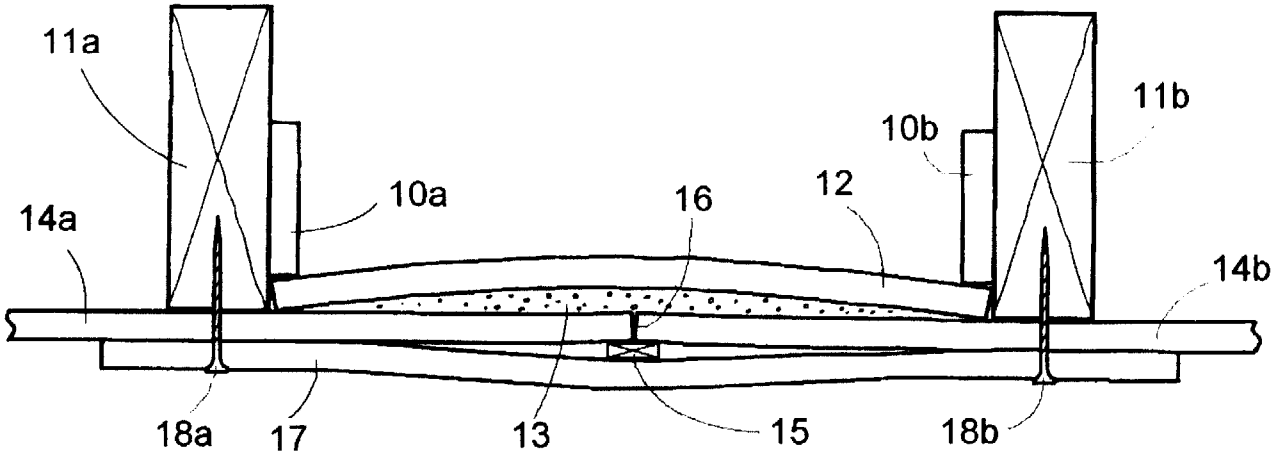
FIG. 1 (Prior Art)
FIGS. 1 and 2 illustrate two common prior art methods for back-blocking.
Figure 2:
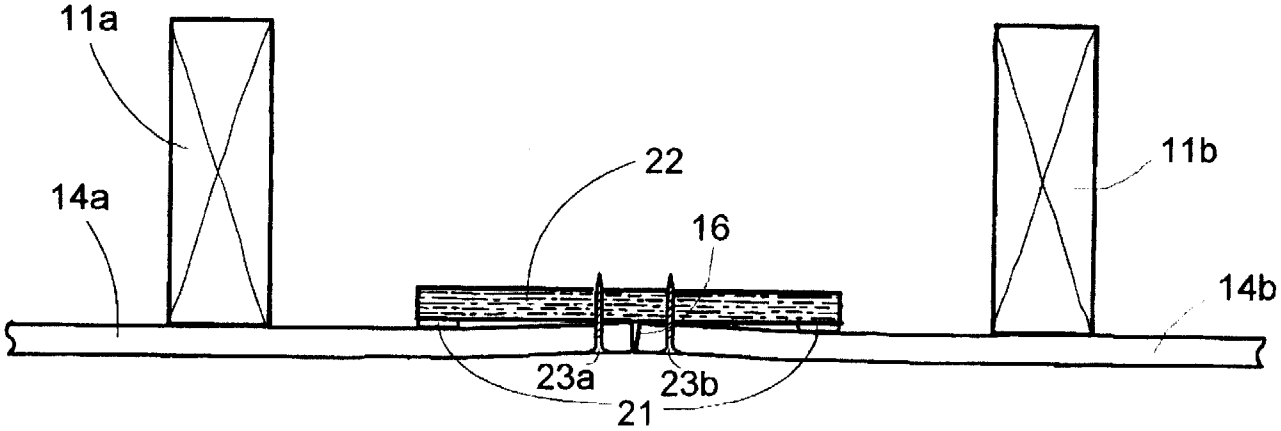
FIG. 2 (Prior Art)

The earlier discussion pertaining to the background of the invention outlines many attempts in the prior art to create seamless, non-ridging butt joints. FIGS. 1 and 2 illustrate two of the more commonly-used back-blocking methods, as outlined by the applicant in Fergusen, Myron R., Drywall, *Professional Techniques for Walls and Ceilings*, Taunton Press, Inc. (1996), at pages 102 and 103.

FIG. 1 illustrates the back-blocking method recommended by the U.S. Gypsum organization. In this method, one begins by attaching scrap drywall strips 10*a* and 10*b* to the sides of respective framing joists 11*a* and 11*b*, set back slightly from the front of said joists, as shown. Next, one loosely fits a second scrap piece of drywall 12 against the front of the scrap strips 10*a* and 10*b* as shown, to act as a back-blocking. Joint compound for back-blocking, 13, is then applied to the front of the scrap drywall piece 12 as shown, and the two drywall panels (first panel 14*a* and second panel 14*b*) to be butted together are nailed or screwed into the respective framing joists 11*a* and 11*b*. A wood strip 15 of approximately 1 inch width×¼ inch thickness is then placed upright so as to cover the entire length of the butted seam 16, with its approximately 1 inch width resting against the seam as shown. A temporary drywall brace 17 is then nailed or screwed (18*a*,*b*) through the drywall panels 14*a* and 14*b* and into the joists 11*a* and 11*b*, as shown. The pressure exerted by the brace 17 against the wood strip 15 and thereby against the seam 16 forces the seam 16 to become slightly recessed with respect the plane of the finished side of the drywall. Once the compound 13 between the drywall panels 14*a* and 14*b* and the back-blocking drywall 12 has set so as to maintain the panels 14*a* and 14*b* in their recessed position, the temporary brace 17 is removed, the holes from attaching the brace are filled, and the slightly-recessed joint 16 is taped and filled with joint compound for finishing, to provide a smooth, concealed joint.

This method has a number of obvious disadvantages. It is very cumbersome and time consuming, and involves many extra steps, including waiting for the back-blocking joint compound 13 to set before tape and joint compound for finishing can be applied (which in turn then also has to set, thus introducing two set cycles). It also utilizes a great deal of scrap material for back-blocking, temporary bracing, etc., and thereby can substantially increase the cost of material for any given job, as well as material waste.

FIG. 2 illustrates an alternative method prior art method which is somewhat less cumbersome than the method of FIG. 1, but still has some important limitations. For purposes of discussion, it is presumed that the length of the butt joint to be created is approximately 48 inches.

In FIG. 2, the first panel 14*a* is nailed or screwed into corresponding framing joist 11*a* so that its butt edge rests approximately halfway between the joists 11*a* and 11*b*. Next, two shims 21 of approximately ⅛ inch thick and 48 inches (or whatever the joint length is) long are attached to a plywood strip 22 with dimensions of approximately ½ inch thick by 10 inches wide by 48 inches (i.e. the butt joint length) long, in the configuration shown. This combination of shims 21 and plywood 22 is then placed behind the first panel 14*a* with the shims 21 facing forward toward the finish side of the drywall and in direct contact with the back (unfinished) side of the drywall, as shown. It is placed so that half of its approximate 10 inch width is hidden by the first panel 14*a*, as shown, and then screwed to that first panel 14*a* with a series of screws 23*a*, as shown. (While the view of FIG. 2 depicts a single screw 23*a*, it is understood that what is used here is a series of screws, vertically aligned in a substantially collinear fashion, and spaced about 8 inches apart.)

Once the shim 21 and plywood 22 combination is securely fastened to the back of panel 14*a* as shown, the second panel 14*b* is screwed into its joist 11*b* so as to butt against the edge of the first panel 14*a*. Then, this second panel 14*b* is also screwed into the plywood panel 22 with a second series of screws 23*b*, as shown. (Again, only a single screw 23*b* is actually depicted in this view.) At this point, the forward (toward the finish side) pressure created by the point of contact between the shims 21 and the backs of the panels 14*a* and 14*b*, combined with the backward (away from the finish side) pressure of the screws 23*a* and 23*b* will cause the joint 16 to be slightly recessed with respect to the plane of the finished wall. Thus, tape and joint compound for finishing can finally be applied in a manner that will hide the butt joint to again provide a smooth, concealed joint.

The method of FIG. 2 is substantially easier than that of FIG. 1. It involves many less steps, does not require anything other than the drywall itself to be attached to the joists, and involves but a single cycle of applying joint compound and waiting for that compound to set. But even this method, simple as it is, has some remaining drawbacks. First, it is necessary to attach the shims 21 to the plywood 22 each time a butt joint is to be formed, which still requires extra work (time) and materials (i.e., plywood and shims). Second, the plywood and shims are fairly heavy and bulky, which creates added work simply bringing materials to and storing them at any given job. Third, because of the plywood and shim weight, there is an extra downward pull behind the butt joint which, over time, may stress the wall and could itself lead to ridging as the building materials shift. Thus, it would be desirable if these remaining problems can be overcome as well.

Figure 3:
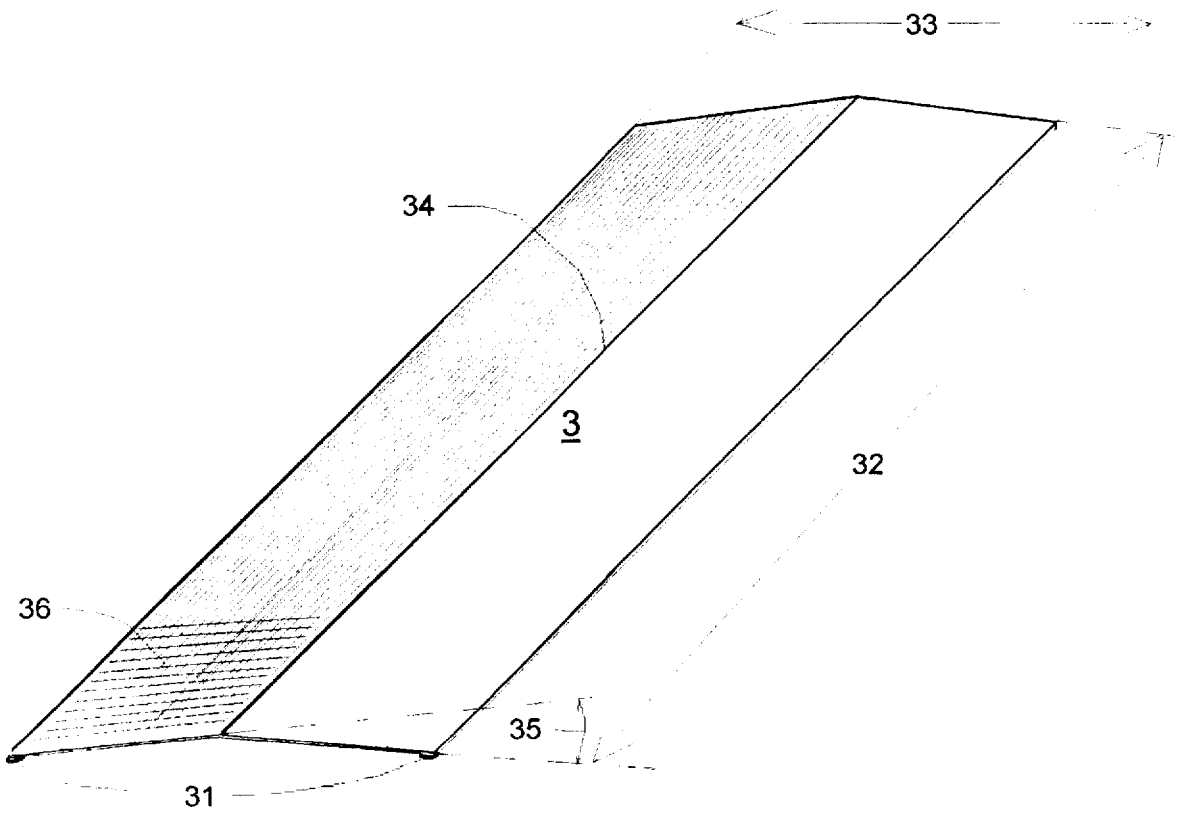
FIG. 3 illustrates a back-blocking strip, which is the essential apparatus used to practice the invention disclosed herein.

FIG. 3 illustrates the back-blocking strip disclosed herein, which resolves all of the prior art problems discussed above.

This back-blocking strip 3 is a specially formed bracket designed to attach the butt ends of drywall panels together. It is preferably made of galvanized sheet metal of approximately 20 to 25 gauge, though other appropriate materials, such as plastic or hard rubber, can also be used. The outside edges of the sheet metal are folded over onto themselves to create thicker, raised outside edges 31, about ⅛ inch thick. Alternatively, instead of folding the edges over, the edges could also be just bent over to an angle of less than 90 degrees to create a lip of about ⅛ inch thick. It is helpful for safety reasons to form these edges in a way that they will not easily cut someone who is handling these strips.

The length 32 of each strip is approximately 47 or 53 inches, to accommodate the two predominate manufactured widths (48 inches and 54 inches) of drywall panels, but a strip can be cut to shorter lengths with, e.g., tin snips, so it can be used for narrower widths of drywall and/or shorter butt joints. Obviously, these strips can of course be manufactured in other lengths as well, and any and all such manufactured lengths are considered within the scope of this disclosure and its associated claims. Each strip has a width 33 of approximately 10 inches and a bend 34 in the middle (i.e. about 5 inches from each side) along its length, inward toward the raised edges of about a 170 degree angle, i.e., it is bent to an angle of about 10 degrees, 35, from that of an unbent 180 degree strip. (Although the preferred width is approximately ten inches, widths from 6 to 14 inches can still be effective and are contemplated by this disclosure and its associated claims.) If the raised edges 31 are made thicker or thinner than the ⅛ inch noted above, or if the strip width differs from the ten inches noted above, then this angle can be varied (e.g., to an angle from 5 to 20 degrees) to compensate accordingly.

Optionally, a knurled or dimpled surface 36 allows for easier penetration of drywall screws (This knurling or dimpling is only illustrated in one section of FIG. 3, though in fact covers substantially the entire surface of the strip). Other surface features that would be obvious to someone of ordinary skill, e.g., scoring, roughness, small holes, etc., can also be added to enable the strip to "grab" tightly to the drywall to which it is attached (stabilization) and aid in starting screws (attachment-facilitating), and are fully contemplated by this disclosure and its associated claims.

Figure 4:
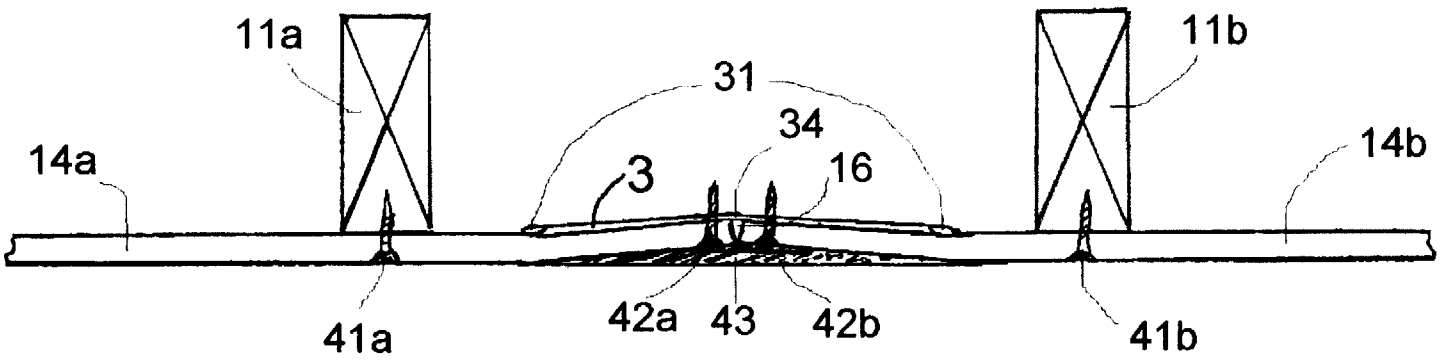
FIG. 4 illustrates the method whereby this back-blocking strip is used to back-block and create a seamless and non-ridging butt joint in accordance with the above-cited objects of the invention.

FIG. 4 depicts the method by which this back-blocking is attached to drywall used to create a seamless, non-ridging joint in accordance with the objects of this invention. This method very much parallels the prior art method outlined in connection with FIG. 2, but, as will be apparent, is far simpler and has significant added benefits.

As in FIG. 2, the first drywall panel is attached via attachment means 41*a* to the wall or ceiling framing 11*a* in a conventional manor. The panel is cut and placed so that the butt edge falls roughly on center between, not upon, framing members 11*a* and 11*b* as shown. Once the first panel is secured in place the back-blocking strip 3 described in FIG. 3 is held in place centering it along the butt edge of the panel, i.e., with the bend 34 in the panel directly behind where the butt joint 16 will be. The concave side of the strip is mounted to face out toward the finished surface of the drywall, with the raised edges 31 thereby also facing out toward, and contacting the hidden (unfinished) surface of, the drywall. A first set of drywall screws 42*a* designed for securing drywall to metal framing are used to attach the drywall to the back-blocking strip 3, similarly to the use of screws 23*a* in FIG. 2. (Although a single screw 42*a* is depicted, it is understood that a plurality of substantially vertically-collinear screws is in fact applied.) Screws should penetrate the back-blocking by ⅜ inch or more, and should be placed about 8 inches apart and ½ inch from the bend 34 of the back-blocking strip (i.e., for a 10 inch strip, about 4½ inches from each edge). The back-blocking is held in place by hand as the screws are installed through the first panel and into the back-blocking.

Once the back-blocking is completely secured to the first panel, the abutting (second) panel 14*b* is placed so as to butt against the first panel 14*a*, is next attached with conventional attachment means 41*b* to the second framing member 11*b*, and is finally attached to the back-blocking 3 using a second set of screws 42*b* similar to 42*a*, designed for securing drywall to metal framing. (Again, while only one screw 42*b* is depicted, it is understood that there are in fact a plurality of screws involved.) It is helpful to start screwing from the middle of the joint and work toward the edges. Screws should again be kept about ½ inch from the strip bend 34 (i.e., about 4½ inches from the edge of a 10 inch strip), thereby opposite the screws of the other (first) panel, and should again be placed about 8 inches apart.

As the drywall panels 14*a* and 14*b* are attached to the back-ground blocking strip 3 with these sets of screws 42*a* and 42*b*, the concave angle of the bend 34 in the strip combined with the thicker outside edges 31 draw the drywall inward toward the strip and inward from the plane of the finished wall, forming a gradual inward (recessed) curve that results in minimal stress on the drywall, as shown. Finally, this recessed seam is now easy to conceal with the application of tape and joint compound 43 over the seam, in the usual manner that is practiced in the art by drywall contractors. The panels are attached to each other, not to the framing, along the butted seam, which greatly reduces the chance of the ridging caused by expansion or contraction of building materials.

As noted before, an optional knurled or dimpled surface features 36 allow for easier penetration of drywall screws, by providing a contour that makes "starting" the penetration easier. Similarly, other surface features that would be obvious to someone of ordinary skill (e.g., scoring or similar small protrusions that come into contact with the back (unfinished) side of the drywall panels) can also be added for stabilization, i.e., to enable the strip to "grab" tightly to the backside of the drywall to which it is attached and provide a solid contact between the strip and the drywall along the entire backside of the drywall surface near the butt joint, and to facilitate starting the screws penetrating the back-blocking (attachment-facilitating).

The basic effects on the drywall produced by the method of FIG. 4, i.e., of causing the butt joint to recess slightly behind the front plane of the finished wall, is similar to the effects produced by the prior art method outlined in FIG. 2. However, the sheet metal back-blocking strip, disclosed in FIG. 3 and used as disclosed in FIG. 4, is far easier to use than the plywood and shim combination of FIG. 2.

First, it is not necessary to attach the shims 21 to the plywood 22 each time a butt joint is to be finished. The bend 34 and raised edges 31 of the back-blocking strip 3 creates the same effect when it is attached to the drywall as the use of shims 21 attached to plywood 22, but are integrally incorporated into the strip 3 in a unitary manner. Thus, one simply takes a strip 3 and attaches the drywall to it as outlined in FIG. 4, without any preparatory steps such as attaching shims to plywood.

Second, the sheet metal strips 3 are much thinner and lightweight than the plywood and shim combination of FIG. 2. One can easily pack a large number of these strips against each other for storage in a small space, and can transport a large number of these onto a job site at one time, which saves time and space.

Finally, because these strips 3 are relatively light, they add minimal extra weight behind the butt joint, and so will not by their very weight contribute to ridging or shifting, as would the much heavier plywood and shim combination of FIG. 2.

The back-block strip 3 of FIG. 3 and its method of use as disclosed in FIG. 4 have numerous advantages over the other prior art as well. Butt joints are indeed between, not upon framing members. Recessing of the butt joint is a natural consequence of the use of the strip 3 as disclosed in FIG. 4. Each butt joint is formed using a single strip 3, as opposed to multiple hardware attachment units or clips as required by some of the other prior art. This saves time and enables sturdy, interconnected attachment along the entire length of the butt joint. The extra time required to use this strip 3 is minimal as compared with virtually all other prior art methods. There is nothing added to the front face of the framing, or indeed, to any portion whatsoever of the framing. No modification is needed to the drywall boards themselves, nor are any tapes or adhesives required. There is no metal edging exposed on the finish side of the drywall or the butt joint, so tape and joint compound are applied directly to the drywall only, resulting in optimum adhesion. There is no limit whatsoever on the thickness of drywall with which this strip 3 can be used. One would simply use longer or shorter sheet metal screws depending upon the thickness of the drywall. In contrast to some of the prior art, the second panel is easily positioned once the first panel has been placed and attached. The disclosed strip 3 can be used for any length of butt joint, since it can be manufactured in any length desired (though 47 and 53 inch lengths make sense considering the standard 48 and 54 inch widths of drywall), and/or can be cut with tin snips or other appropriate cutting devices to any lengths desired for a particular butt joint. Finally, the end result is a slightly-recessed joint that is easy to conceal and will not ridge or crack with the shifting of framing, since the strip 3 and the butt joint float between framing members, and since the mild recess in the butt joint allows tape and joint compound to be applied so as to create an entirely smooth surface on the finish side of the drywall.

While the discussion and illustrations above have referenced the use of drywall in an upright (vertical) configuration to create a side wall, it is obvious that the device and method outlined herein could also be used for ceilings, and indeed, for any drywall contracting where it is desired to create a smooth, seamless, non-ridging surface.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A drywall back-blocking device, comprising:

a substantially-rectangular, continuous strip of given length and width; and a concave bend of a given bend angle between 160 and 175 degrees, substantially centered in the middle of the strip width and running parallel to the length of the strip, thereby defining first and second strip halves of said strip on each side of, and meeting at, said concave bend; and raised outside edges running parallel to the strip; wherein each of said first and second strip halves is substantially flat; and wherein only said first and second strip halves of said device meet along said concave bend.

2. The back-blocking device of claim 1, further comprising attachment-facilitating surface features to facilitate entry of drywall attachment devices into and through the strip.

3. The back-blocking device of claim 1, further comprising stabilization surface features to enable the strip to maintain stable, non-shifting contact with drywall panels attached to said strip in contact with said stabilization surface features.

4. The back-blocking device of claim 1, wherein the width of said strip is between 6 and 14 inches.

5. The back-blocking device of claim 1, wherein said strip is manufactured to a length selected from the group of lengths consisting of approximately 47 inches and approximately 53 inches.

6. The back-blocking device of claim 1, wherein said strip is fabricated of sheet metal.

7. The back-blocking device of claim 1, wherein said strip is fabricated of plastic.

8. The back-blocking device of claim 1, wherein said strip is fabricated of hard rubber.

9. A drywall back-blocking device in combination with a drywall construction, comprising:

a substantially-rectangular, continuous strip of given length and width; and a concave bend of a given bend angle, substantially centered in the middle of the strip width and running parallel to the length of the strip, thereby defining first and second strip halves of said strip on each side of, and meeting at, said concave bend; wherein each of said first and second strip halves is substantially flat;

only said first and second strip halves of said device meet alone said concave bend;

a first drywall panel is attached to a first framing member such that a first butt end of said first drywall panel is substantially centered between said first framing member and a second framing member;

said strip is attached behind said first drywall panel such that the concave bend faces outward toward a finished surface of the first panel and the bend is located substantially behind said butt end of the first panel, thereby attaching and covering approximately said first strip half of said strip and leaving exposed approximately said second strip half of said strip;

a second drywall panel is attached to said second framing member such that a butt end of said second drywall panel substantially contacts and butts against said first butt end of said first drywall panel and rests in front of and thereby covers said second strip half of said strip; and said second drywall panel is attached to said second strip half of said back-blocking strip; whereby a butt joint thereby created where the butt ends of said panels meet is caused to be slightly recessed; whereby the first and second panels may be brought directly into contact with one another along said butt ends of said panels without obstruction from said device; whereby joint compound and tape may be applied directly to said butt joint and surface areas of said panels proximate said butt joint without obstruction from said device; and whereby a thickness of said drywall panels are not limited by said device.

10. A method of back-blocking and creating an easy-to-conceal drywall butt joint, comprising the steps of:

attaching a first drywall panel to a first framing member such that a first butt end of said first drywall panel is substantially centered between said first framing member and a second framing member;

attaching behind said first drywall panel, a substantially rectangular, continuous back-blocking strip device of given length and width, comprising a concave bend of a given bend angle substantially centered in the middle of the strip width and running parallel to the length of the strip and thereby defining first and second strip halves of said strip on each side of, and meeting at, said concave bend, such that the concave bend faces outward toward a finished surface of the first panel and the bend is located substantially behind said butt end of the first panel, thereby attaching and covering approximately the first half of said strip device and leaving exposed approximately the second half of said strip device;

attaching a second drywall panel to said second framing member such that a butt end of said second drywall panel substantially contacts and butts against said first butt end of said first drywall panel and rests in front of and thereby covers the second half of said back-blocking strip device; and attaching said second drywall panel to the second half of said back-blocking strip device; wherein each of said first and second strip halves is substantially flat; and wherein for said strip device, only said first and second strip halves of said strip device meet along said concave bend; whereby a butt joint thereby created where the butt ends of said panels meet is caused to be slightly recessed; whereby the first and second panels may be brought directly into contact with one another along said butt ends of said panels without obstruction from said strip device; whereby joint compound and tape may be applied directly to said butt joint and surface areas of said panels proximate said butt joint without obstruction from said strip device; and whereby a thickness of said drywall panels are not limited by said device.

11. The method of claim 10, wherein said back-blocking strip further comprises raised outside edges running parallel to the length of the strip.

12. The method of claim 10, wherein said back-blocking strip further comprises attachment-facilitating surface features to facilitate entry of drywall attachment devices into and through the strip.

13. The method of claim 10, wherein said back-blocking strip further comprises stabilization surface features to enable the strip to maintain stable, non-shifting contact with the first and second drywall panels when attached to said strip in contact with said stabilization surface features.

14. The method of claim 10, wherein said bend angle of said concave bend is between 160 and 175 degrees.

15. The method of claim 10, wherein the width of said strip is between 6 and 14 inches.

16. The method of claim 10, wherein the first and second panels are attached to the back-blocking strip with drywall screws.

17. The method of claim 10, further comprising the step of taping said slightly-recessed butt joint and then filling and covering said slightly-recessed butt joint with joint compound.

18. A method of back-blocking and creating an easy-to-conceal, non-ridging drywall butt joint, comprising the steps of:

attaching a first butt end of a first drywall panel and a second butt end of a second drywall panel to one another by attaching each of said panels to a substantially rectangular, continuous back-blocking strip of given length and width, comprising a concave bend of a given bend angle substantially centered in the middle of the strip width and running parallel to the length of the strip, thereby defining first and second strip halves of said strip on each side of, and meeting at, said concave bend; wherein each of said first and second strip halves is substantially flat; and wherein only said first and second strip halves of said device meet along said concave bend; whereby a butt joint thereby created where the butt ends of said panels meet is caused to be slightly recessed; whereby the first and second panels may be brought directly into contact with one another along said butt ends of said panels without obstruction from said strip device; and whereby joint compound and tape may be applied directly to said butt joint and surface areas of said panels proximate said butt joint without obstruction from said strip device; and whereby a thickness of said drywall panels are not limited by said device.

* * * * *